US007936117B2

(12) United States Patent
Huang

(10) Patent No.: US 7,936,117 B2
(45) Date of Patent: May 3, 2011

(54) STRUCTURE OF SPARK PLUG

(76) Inventor: Chien-Kuo Huang, Jiali Town (TW)

( * ) Notice: Subject to any disclaimer, the term of this patent is extended or adjusted under 35 U.S.C. 154(b) by 0 days.

(21) Appl. No.: 12/472,389

(22) Filed: May 27, 2009

(65) Prior Publication Data

US 2010/0301732 A1 Dec. 2, 2010

(51) Int. Cl.
*H01T 13/20* (2006.01)

(52) U.S. Cl. ..... 313/141; 313/140

(58) Field of Classification Search ..... 313/141, 313/123, 140

See application file for complete search history.

(56) References Cited

U.S. PATENT DOCUMENTS 5,264,754 A * 11/1993 Hanitijo et al. ..... 313/139
2005/0127809 A1* 6/2005 Lindsay ..... 313/141

* cited by examiner

*Primary Examiner* — Vip Patel
(74) *Attorney, Agent, or Firm* — Leong C. Lei

(57) ABSTRACT

Disclosed is a park plug, which has a conductive plate constituting a side electrode, and a slot is defined through the conductive plate, so that no dead zone is present around the spark plug for a fuel injection system and thereby achieving more complete combustion. The spark plug is threadingly fit into a combustion chamber of an engine and employs a high-voltage electric current to generate spark for ignition and thus enabling combustion and explosion to generate power for driving movement of cylinders. Thus, by providing a slot in the conductive plate of the side electrode, a mixture gas of fuel and air inside the combustion chamber can be completely spread around the spark plug to thereby enhance combustion efficiency. This not only reduces fuel consumption and enhances horsepower, but also eliminates jamming of an injection engine due to less carbon deposition.

4 Claims, 8 Drawing Sheets

STRUCTURE OF SPARK PLUG

TECHNICAL FIELD OF THE INVENTION

The present invention generally relates to an improved structure of a spark plug, which comprises two electrodes insertable into an engine combustion chamber of which a negative electrode comprises a conductive plate defining a slot therethrough so that a mixture gas of fuel and air inside the combustion chamber can be completely distributed around the spark plug to ensure complete combustion when ignited and thus enhance fuel efficiency.

DESCRIPTION OF THE PRIOR ART

A spark plug generates electric sparks to ignite fuel. The spark plug is fit into a wall of a combustion chamber of an engine. Most known cars and motorcycles use a spark plug that is designated at 1 in FIG. 1 of the attached drawings. The spark plug 1 comprises a threaded section 10 for penetrating into the wall of the combustion chamber. The threaded section 10 is provided with a stop flange 100 to limit the depth of penetration thereof and is also provided with a hexagonal nut 101 for expediently mounting and dismounting the spark plug. An opposite end of the spark plug 1 forms a connection terminal 11 for connection with an electrical power source. The threaded section 10 comprises two electrodes that are positioned into the combustion chamber, wherein an positive electrode or central electrode is formed as a pole 12 set in the center and a negative electrode or a side electrode is formed as an angled conductive plate 13 that extends upward from a side wall and has a bent free top end. When a gas mixture inside the combustion chamber is densely compressed, the ignition structure of the spark plug is energized by high-voltage electrical current to have the spark plug 1 carrying out ignition.

To raise the vehicle horsepower, the high-voltage electric current applied to effect ignition in the spark plug must be increased. Thus, to ensure that the negative electrode 23 of a spark plug 2 can carry the current, an additional conductive plate is provided (as shown in FIG. 2). For high class vehicles, the horsepower is even raised higher and thus a further conductive plate 33 is provided, making a spark plug 3 comprised of three conductive plates 33 that are angularly spaced by 120 degrees (as shown in FIG. 3). At to the topmost class vehicle, besides the special design applied to the engine, the output horsepower is incredibly high and to ensure the conductive plate 43 of the spark plug 4 is capable to carry the current, four conductive plates 43 are provided and angular spaced by 90 degrees, making the spark plug 4 comprised of four conductive plates 43 (as shown in FIG. 4). The conventional spark plugs, whether a one-conductive-plate plug or a four-conductive-plate one, all effective in carrying out ignition, but they still have certain disadvantages:

(1) For a conventional spark plug, no matter how many conductive plates 1 it may have, the conductive plate occupies a space by its width, which prevents the cylinder like spark plug from completely eliminating any potential dead zone around it, whereby the combustion cannot be complete and is around 80% only. The greater the age of a car is, the poorer the efficiency it may have.

(2) The conventional spark plug, due to being incapable of complete combustion cannot provide the greatest explosive force of engine combustion, making the use of the power thereof limited and in turn imposing an undesired constrain to the output horsepower.

(3) Since the conventional spark plug has a poor combustion efficiency, it is not possible to reduce fuel consumption and for a spark plug having multiple conductive plates, although a high horsepower can be generated, is suffers even worse combustion efficiency due to the fuel is blocked more severely by the conductive plates, leading to incredibly high consumption of fuel.

(4) The conventional spark plug not only prevents ejected fuel from being combusted completely, but also easily generates carbon deposition, causing jamming of nozzles of injection engine.

(5) Since the combustion is incomplete, the discharge of CO and HC is of a high amount, which does not meet the requirement and thus a catalyst converter must be added to filter and re-direct the exhaust gas in order to satisfy the requirement for gas exhaust.

Thus, in view of the fact that the conventional spark plug does not suit the needs, the present invention aims to provide a spark plug structure that reduces fuel consumption, increases horsepower, and lowers the amount of exhaust gas.

SUMMARY OF THE INVENTION

The present invention relates to an improved novel design of spark plug, and especially an improved spark plug that reduces fuel consumption, increases explosive force induced by combustion inside an engine, and lowers the exhaust gas to an amount that is almost none. The feature is a slot defined in a conductive plate, or side electrode, of a spark plug to prevent the occurrence of dead zones around the spark plug for a fuel injection system and thereby achieving more complete combustion. The spark plug is threadingly fit into a combustion chamber of an engine and employs a high-voltage electric current to generate spark for ignition and thus enabling combustion and explosion to generate power for driving movement of cylinders. Thus, by providing a slot in the conductive plate of the side electrode, the mixture gas of fuel and air inside the combustion chamber can be fully spread within a 360 degree range around a circumference of the spark plug to thereby enhance combustion efficiency. This not only reduces fuel consumption and enhances horsepower, but also eliminates jamming of nozzles of an injection engine due to less carbon deposition resulting from more complete combustion.

The foregoing objective and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
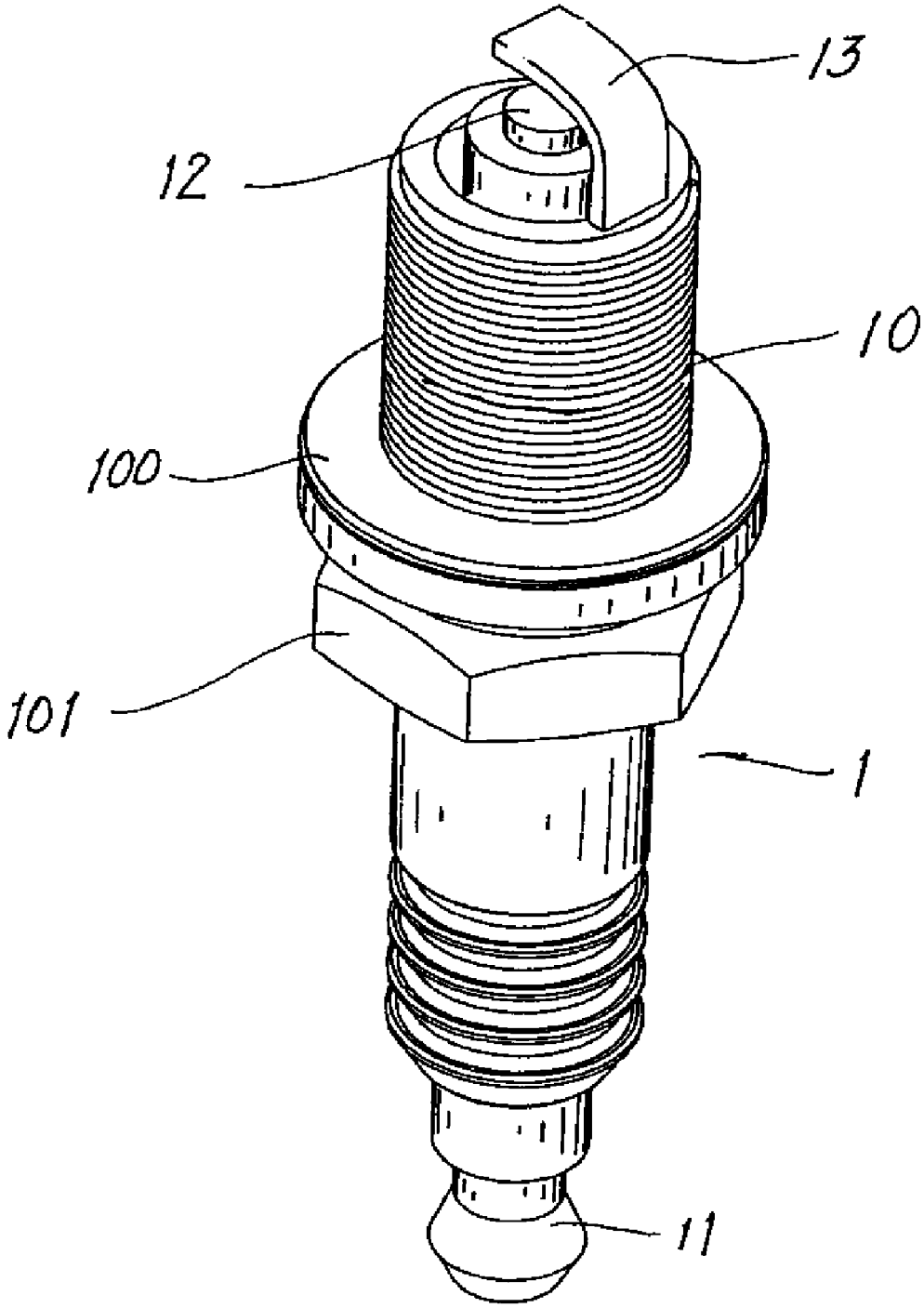
FIG.1 PRIOR ART
FIG. 1 is a perspective view of a conventional spark plug.
Figure 2:
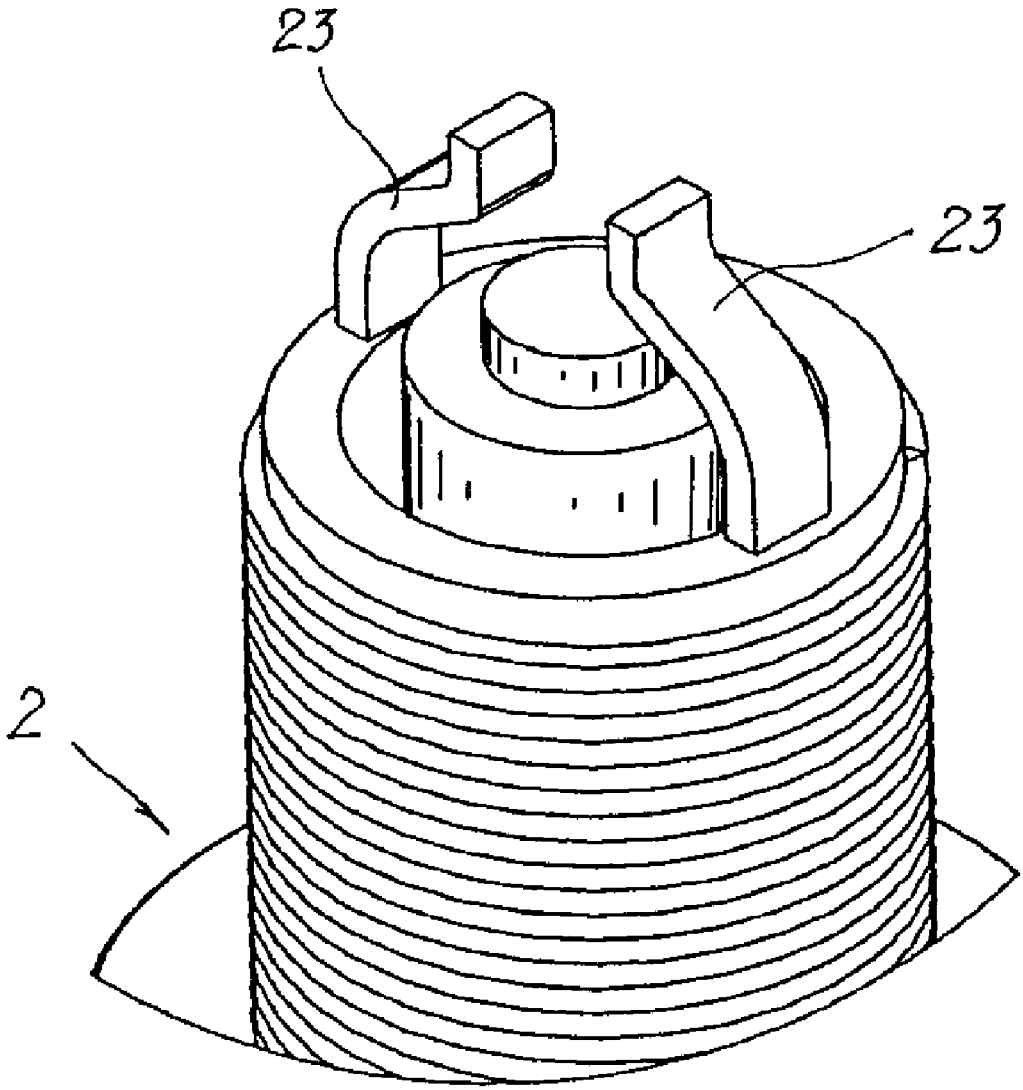
FIG.2 PRIOR ART
FIG. 2 is a perspective view of a conventional two-side-electrode spark plug.
Figure 3:
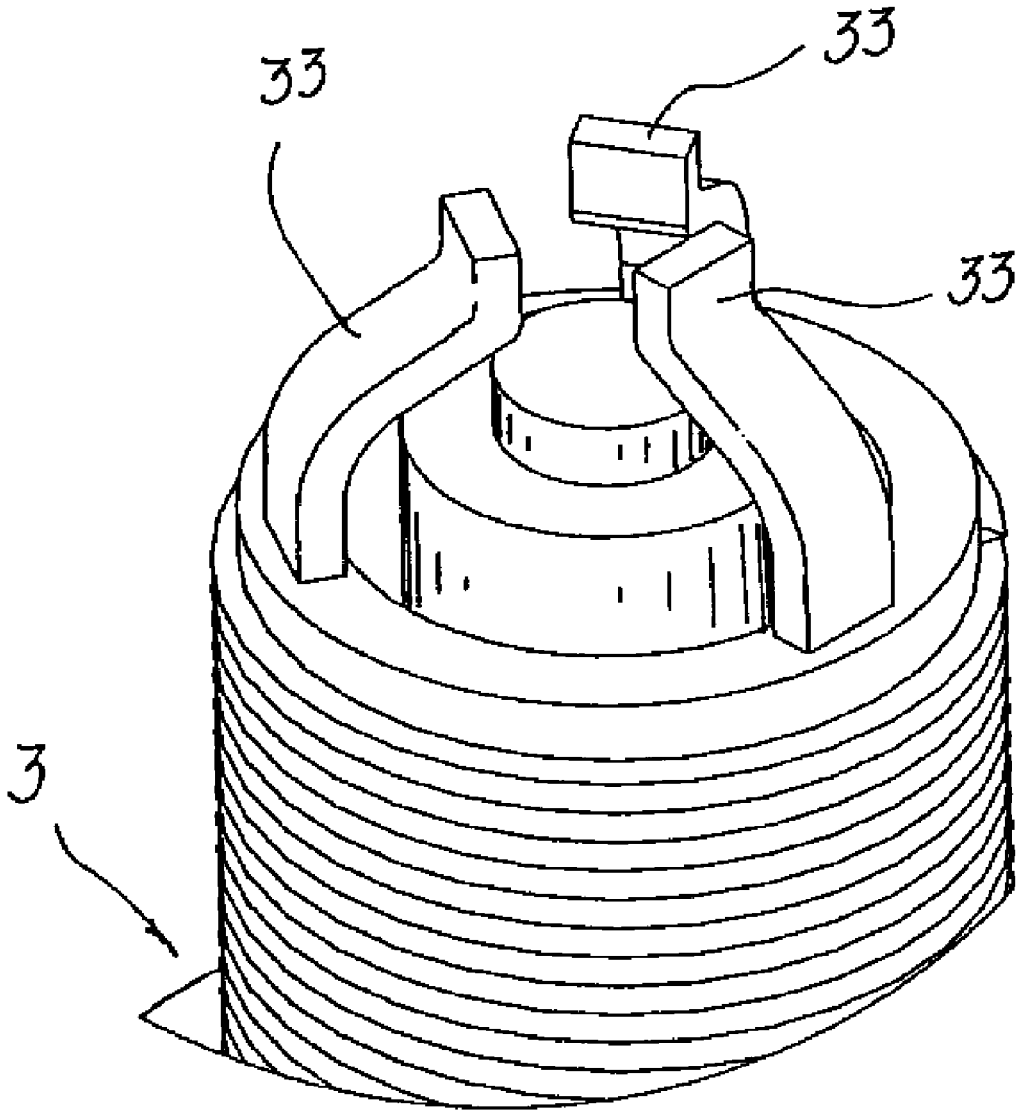
FIG.3 PRIOR ART
FIG. 3 is a perspective view of a conventional three-side-electrode spark plug.
Figure 4:
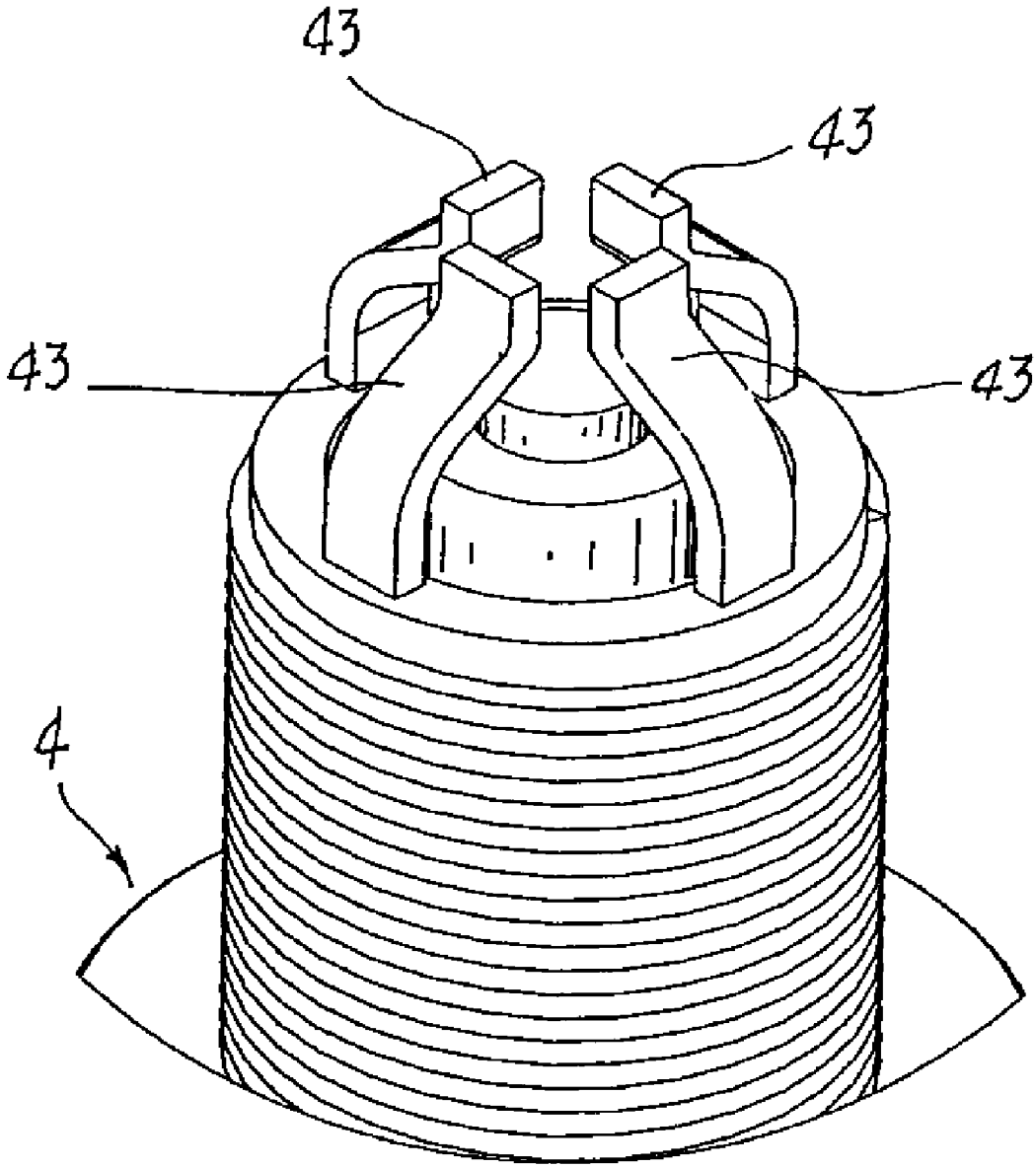
FIG.4 PRIOR ART
FIG. 4 is a perspective view of a conventional four-side-electrode spark plug.
Figure 5:
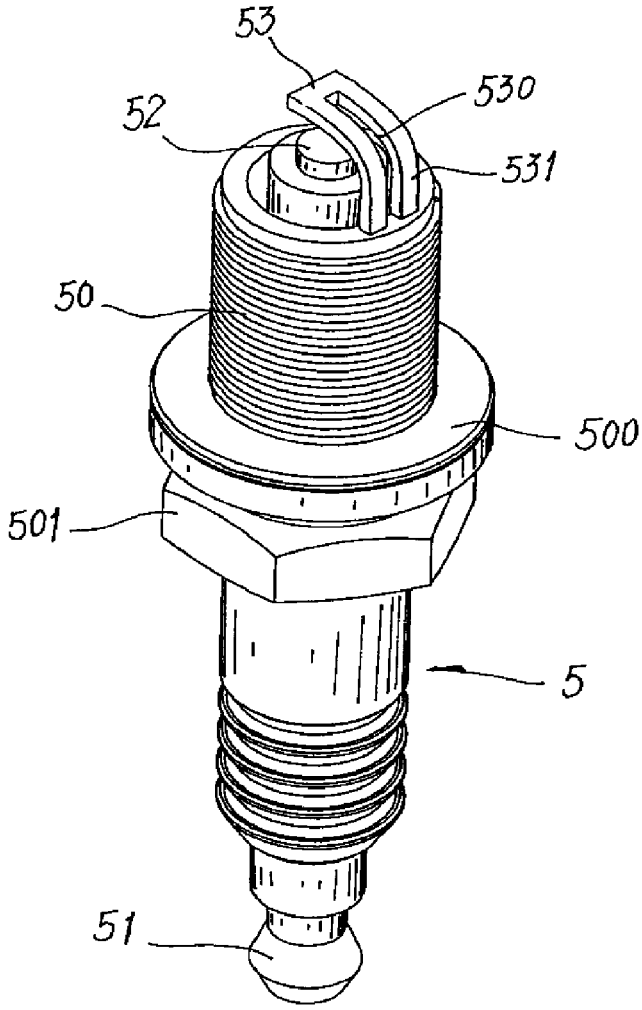
FIG. 5 is a perspective view showing a spark plug constructed in accordance with an embodiment of the present invention.

With reference to the drawings and in particular to FIG. 5, which shows a perspective view of a spark plug constructed in accordance with a preferred embodiment of the present invention, the spark plug, generally designated at 5, forms at one end thereof a threaded section 50 for threadingly mounting to a wall of an engine combustion chamber. A stop flange 500 is provided on the threaded section 50 to limit the depth that the spark plug 5 can penetrate into the combustion chamber. Also provided is a hexagonal nut 501 for expediently mounting and dismounting the spark plug 5. An opposite end of the spark plug 5 forms a connection terminal 51 for connection and transmission of electrical power. The threaded section 50 comprises two electrodes that are positioned into the engine combustion chamber, wherein a positive electrode or central electrode is formed as a pole 52 set in the center and a negative electrode or a side electrode is formed as a conductive plate 53, which extends upward from a side wall and has a bent free top end. When a gas mixture inside the combustion chamber is densely compressed, the ignition means of the spark plug 5 is energized by high-voltage electrical current to have the spark plug 5 carrying out ignition. The conductive plate 53 of the negative electrode forms a side tab 531, which is a major cause for incomplete combustion, for the side tab 531 forms a dead zone for a fuel injection system, making it not possible to realize complete combustion. Thus, a slot 530 is formed in the side tab 531 and extends from the top end to a bottom end of the side tab 531, but with the top end connected and closed. In this way, the fuel injection system can do spraying around the spark plug 5 through the slot 530 thereby realizing complete combustion.

Figure 6:
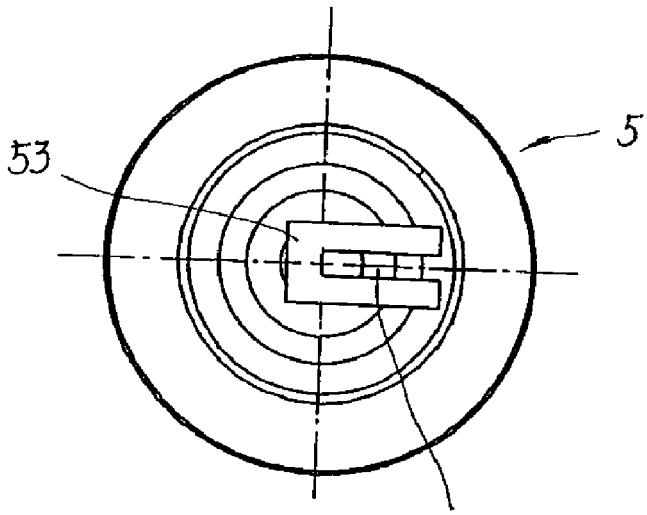
FIG. 6 is a top view of the spark plug of the present invention.

Next, also referring to FIG. 6, which is a top view of the spark plug of the present invention, the conductive plate 53 of the spark plug 5, although forming the slot 530, still maintain a connected and closed top end, because when the spark plug 5 performs ignition, which is done with high-voltage electric current, an over-thinned conductive plate 53 is not capable to carry the electric current and this is why the top end must be kept closed and connected for enabling the modified conductive plate 53 to carry the same electric current that a non-modified conductive plate is designed to take. Further, the slot 530 defined through the side tab 531 allows the fuel injection system to eject the mixture around the spark plug 5 to realize complete combustion.

Figure 7:
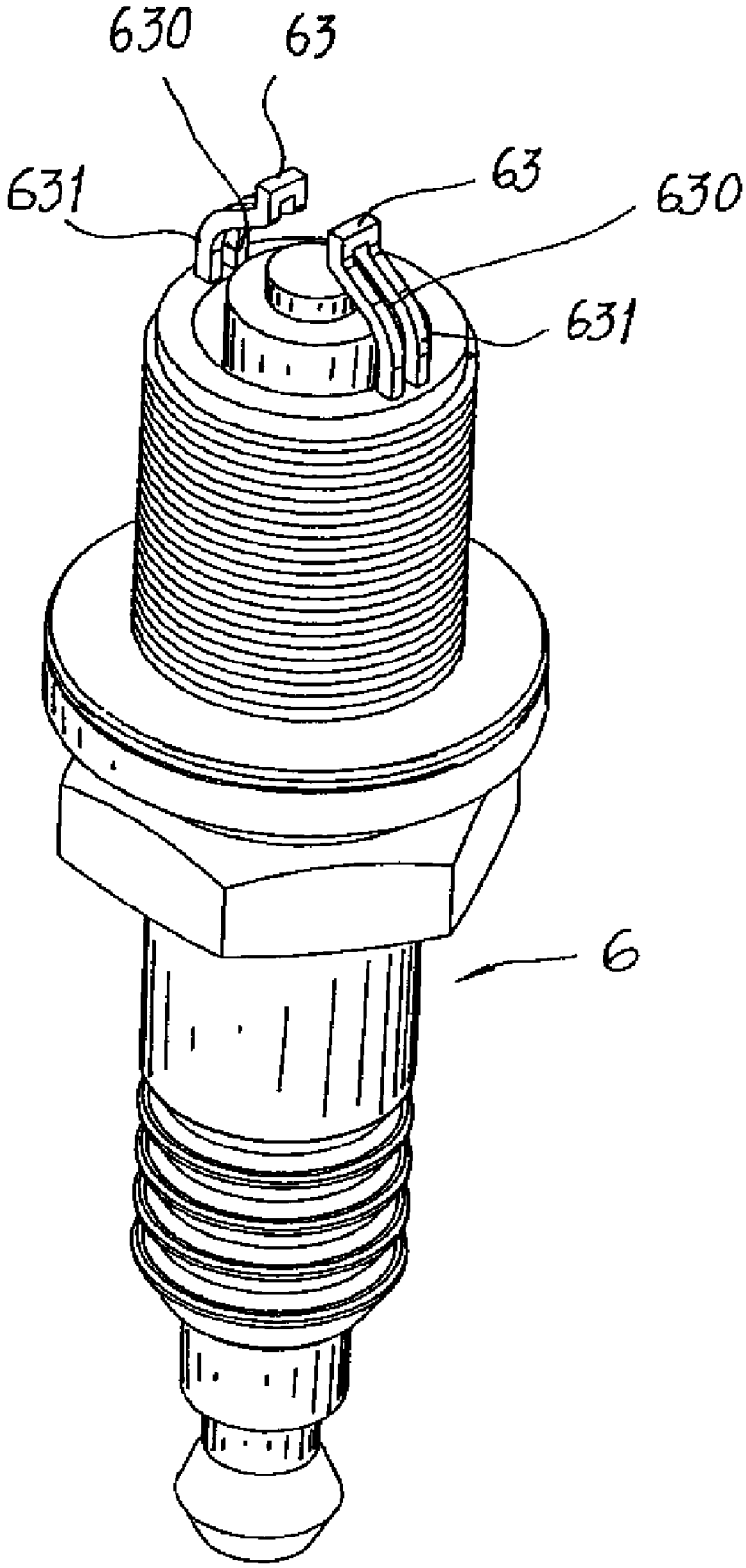
FIG. 7 is a perspective view showing a spark plug having two side electrodes constructed in accordance with another embodiment of the present invention.

For a vehicle that outputs a higher horsepower, a traditional single-piece side electrode is not capable to take the high-voltage electric current for the higher horsepower and thus a pair of symmetric conductive plates is provided, as shown in FIG. 7. The spark plug 6 is provided with two opposite conductive plates 63 serving as negative electrodes on the threaded section of the spark plug. Similarly, each conductive plate 63 has a side tab 631 in which a slot 630 is defined and both conductive plates 63 form the slot 630. Therefore, the fuel injection system is allowed to spray fuel around the spark plug and dead zones can be eliminated to ensure more complete combustion.

Figure 8:
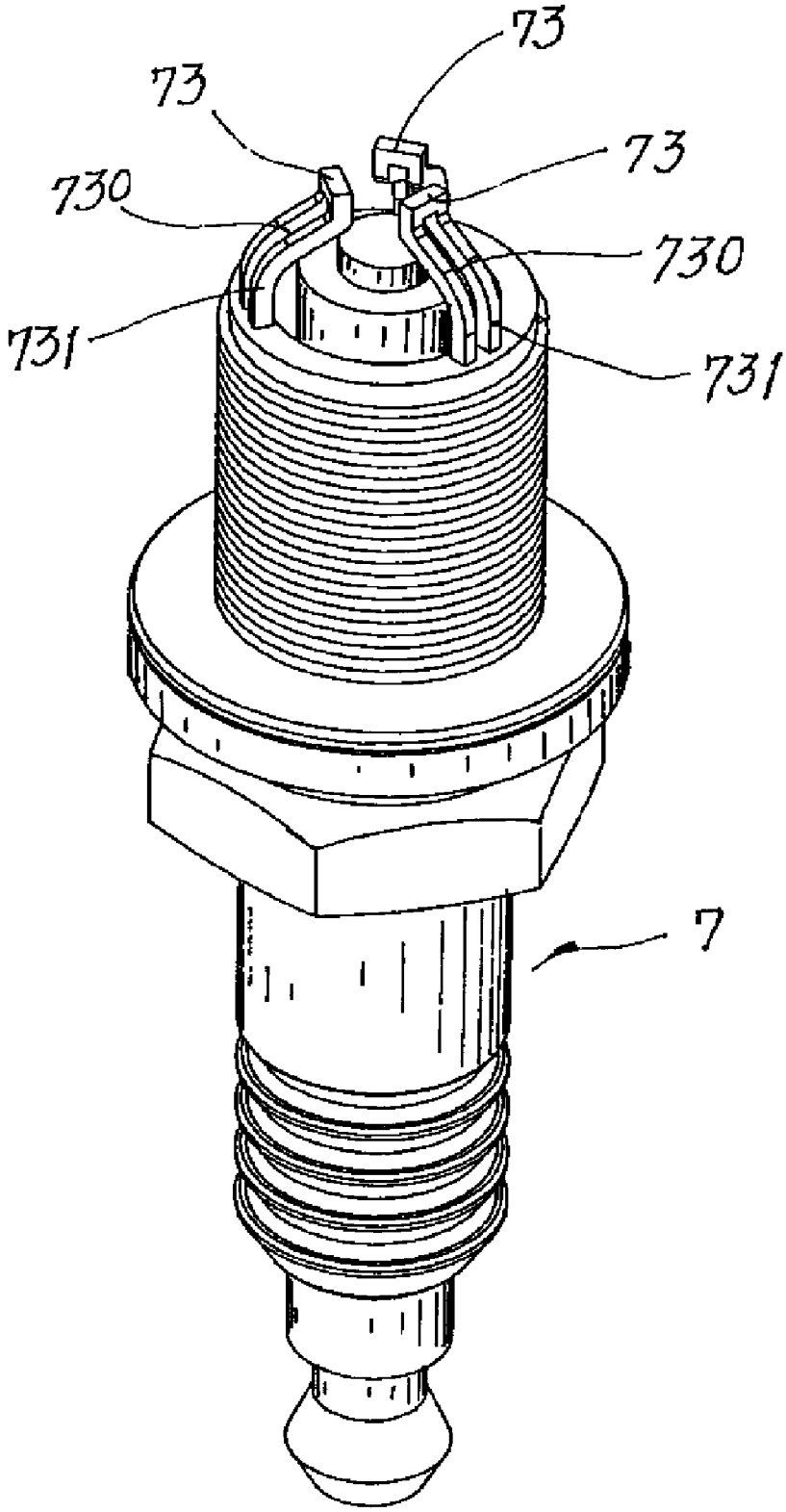
FIG. 8 is a perspective view showing a spark plug having three side electrodes constructed in accordance with a further embodiment of the present invention.

Next, for a spark plug 7 used in a luxury car, as shown in FIG. 8, the design of conductive plates 73 is a three-piece side electrode arrangement angularly spaced by 120 degrees in order to take the high-voltage electric current required for generation of high horsepower. Although this can also be done with a conventional spark plug, the arrangement of three-side-electrode conductive plates makes it more dead zones for fuel injection and the combustion cannot be complete, leading to generation of exhaust gas and incredibly high fuel consumption. The present invention similarly forms through slots 730 in the side tabs 731 of the three conductive plates 73, whereby fuel can be sprayed around the spark plug 7 through the slots 730 to eliminate the dead zones and make the combustion complete, eventually leading to reduced consumption of fuel and less exhaust gas.

Figure 9:
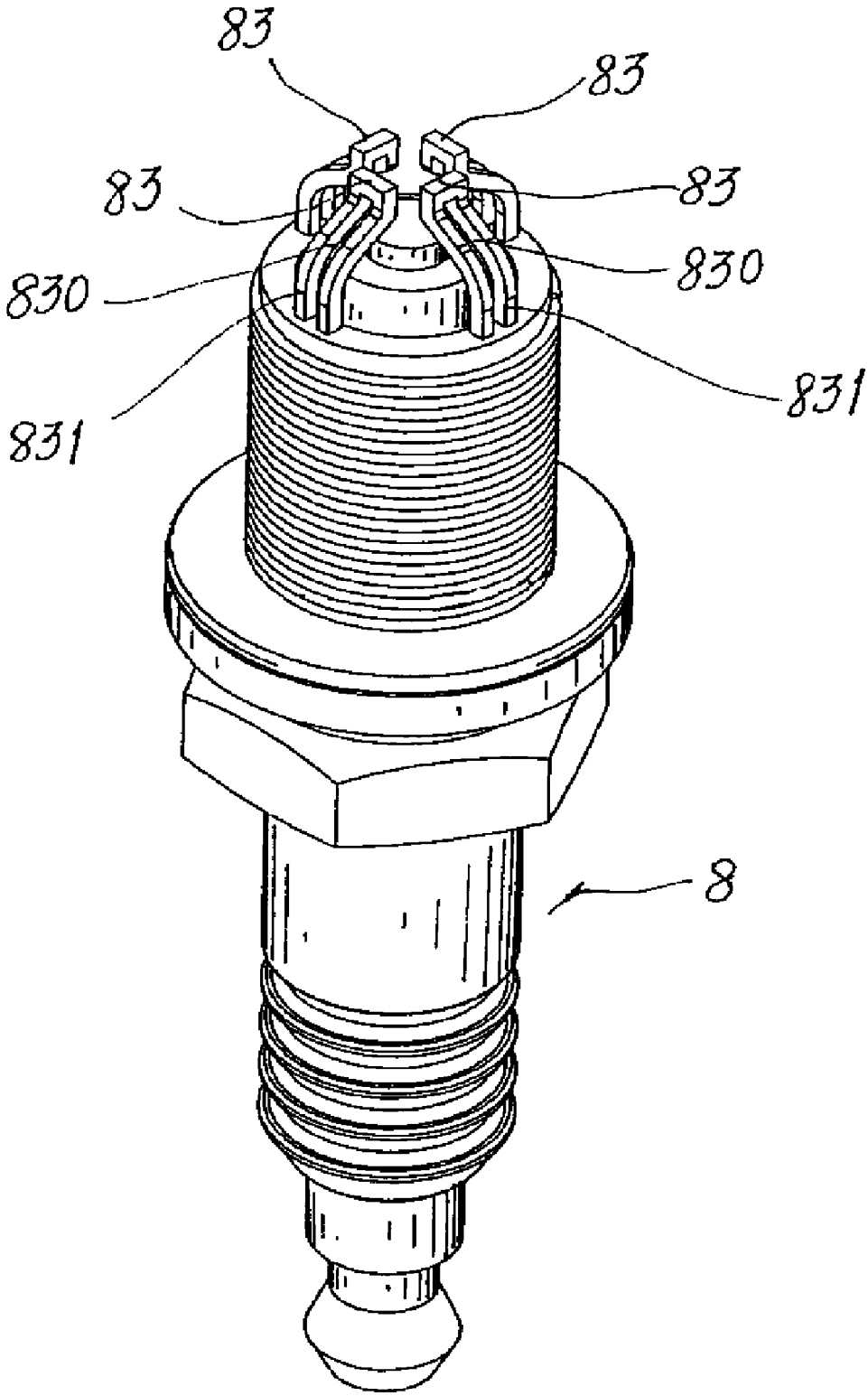
FIG. 9 is a perspective view showing a spark plug having four side electrodes constructed in accordance with yet a further embodiment of the present invention.

For topmost class of cars, a four-side-electrode spark plug 8 is adopted, as shown in FIG. 9. The topmost class car has an engine that is specially designed in every respect, but still there is the same problem in connection with the spark plug 8 thereof. Thus, the present invention similarly forms a through slot 830 in a side tabs 831 of each conductive plate 83 but with a top end of each conductive plate connected and closed to enable the conductive plate 83 to carry the high-voltage electric current required for the high output horsepower. With the arrangement of the slot 830 in each conductive plate, fuel can be uniformly sprayed around the spark plug 8 to eliminate the dead zones and make the combustion complete, eventually leading to less amount of exhaust gas to realize reduced consumption of fuel.

Apparently, the present invention provides a spark plug having a side electrode that forms a through slot and the following advantages are offered:

(1) The present invention uses the slot formed through the conductive plate in order to allow fuel to pass through the conductive plate and avoid undesired blocking so that combustion caused by ignition carried out by the spark plug can be more complete, at least higher 95%, to thereby reduce fuel consumption (saving fuel).

(2) The present invention provides a spark plug that has less dead zones during fuel injection and enhances combustion, thereby improving the explosive force of engine combustion and thus increasing the output horsepower.

(3) The present invention provides a more complete combustion and less generation of carbon deposition so that nozzles of an injection engine are not likely to get jammed, making the service life thereof extended to realize better economic benefits.

(4) Since the combustion is made complete, exhaust gas (CO and HC) discharged from the exhaust pipe can be made close to zero to meet the requirement for environmental conservation, energy saving and carbon reduction.

To summarize, the present invention uses a slot formed in a side electrode of a spark plug to enable uniform distribution of injected fuel around the spark plug and eliminate dead zones so that combustion is made more complete and horsepower increased without affecting the original construction but capable to carry the high-voltage electric current. Through the more complete combustion, fuel consumption and exhaust gas can both be reduced.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A spark plug comprising:

a first end provided with a threaded section for threadingly mounting to a wall of an engine combustion chamber;

a stop flange provided under said threaded section;

a hexagonal nut under said flange;

a second end provided with a connection terminal;

wherein said threaded section comprises a positive electrode and a negative electrode, said positive electrode being formed as a pole set in a center of said threaded section, said negative electrode being formed as a conductive plate extending upward from a side wall of said threaded section and having a bent free top end, said conductive plate having a slot extending from a top end of said conductive plate to a bottom end of said conductive plate, but with said top end connected and closed.

2. The spark plug as claimed in claim 1, wherein said negative electrode comprises two conductive plates each forming a slot.

3. The spark plug as claimed in claim 1, wherein said negative electrode comprises three conductive plates each forming a slot.

4. The spark plug as claimed in claim 1, wherein said negative electrode comprises four conductive plates each forming a slot.

* * * * *